US007958657B2

(12) United States Patent
Sakamoto et al.

(10) Patent No.: US 7,958,657 B2
(45) Date of Patent: Jun. 14, 2011

(54) FIXING STRUCTURE OF WORK MACHINE

(75) Inventors: Kunihiko Sakamoto, Chikugo (JP); Yasuo Tokieda, Chikugo (JP); Hayato Tsuji, Chikugo (JP); Syoubu Aramaki, Chikugo (JP)

(73) Assignee: Yanmar Co., Ltd., Osaka (JP)

( * ) Notice: Subject to any disclaimer, the term of this patent is extended or adjusted under 35 U.S.C. 154(b) by 522 days.

(21) Appl. No.: 12/067,003

(22) PCT Filed: Jan. 20, 2006

(86) PCT No.: PCT/JP2006/300802

§ 371 (c)(1),
(2), (4) Date: May 8, 2008

(87) PCT Pub. No.: WO2007/034577

PCT Pub. Date: Mar. 29, 2007

(65) Prior Publication Data

US 2010/0260539 A1 Oct. 14, 2010

(30) Foreign Application Priority Data

Sep. 20, 2005 (JP) ..... 2005-272817

(51) Int. Cl.
*E02F 3/96* (2006.01)
*E02F 3/28* (2006.01)

(52) U.S. Cl. ..... 37/468; 414/723

(58) Field of Classification Search ..... 37/450–456, 37/448, 468; 403/374, 379, 321; 299/91–93; 172/713, 750, 751, 772.5; 414/723, 724
See application file for complete search history.

(56) References Cited

U.S. PATENT DOCUMENTS 1,035,160 A * 8/1912 Cook ..... 279/86
1,168,469 A * 1/1916 Benson ..... 172/703
3,413,740 A * 12/1968 Petersen ..... 37/457
3,985,249 A 10/1976 Aker et al.

(Continued)

FOREIGN PATENT DOCUMENTS

JP 55-177517 12/1980

(Continued)

OTHER PUBLICATIONS

International Search Report for International Application No. PCT/JP2006/300802, Japanese Patent Office, mailed Mar. 14, 2006, 2 pgs.

(Continued)

*Primary Examiner* — Robert E Pezzuto
(74) *Attorney, Agent, or Firm* — Sterne, Kessler, Goldstein & Fox P.L.L.C.

(57) ABSTRACT

In the conventional connection and fixture part between a working vehicle and an excavator, a connection pin is made to contact a guide plate to be fixed in position, thereby requiring a high rigidity of the guide plate, accuracy of recreation of positioning of the connection pin, and high cost for manufacturing the guide plate. Thus, a guide plate of a connection portion has a chevron-shaped introduction part including two sector curves. A U-shaped bent member serving as a knob is provided on a rear side surface of a connection pin in the axial direction of the connection pin, so that the proper position of the inserted connection pin is defined as the position thereof when tips of the knob come into contact with the insertion-target member.

7 Claims, 13 Drawing Sheets

U.S. PATENT DOCUMENTS

| | | | | |
|---|---|---|---|---|
| 5,074,062 | A * | 12/1991 | Hahn et al. | 37/456 |
| 5,713,145 | A * | 2/1998 | Ruvang | 37/458 |
| 7,299,570 | B2 * | 11/2007 | Emrich et al. | 37/455 |

FOREIGN PATENT DOCUMENTS

| | | |
|---|---|---|
| JP | 62-38964 | 3/1987 |
| JP | 08 060690 | 3/1996 |
| JP | 10-046582 | 2/1998 |
| JP | 2003129513 | 5/2003 |
| JP | 2004-092306 | 3/2004 |
| JP | 2004 316168 | 11/2004 |

OTHER PUBLICATIONS

Supplementary European Search Report for European Application No. EP 06 712027, mailed Mar. 1, 2010, 7 pgs.

* cited by examiner

FIXING STRUCTURE OF WORK MACHINE

FIELD OF THE INVENTION

The present invention relates to a fixing structure for fixing a work machine to a working vehicle. In particular, the present invention relates to a technology for achieving a connection structure of an excavator that is inexpensive and easy to be operated.

BACKGROUND ART

There is a well-known conventional mechanism for connecting an excavator to a working machine, including a hook and a lock pin, such as to be detachable and easy to operate, as disclosed in Patent Literature 1.

Patent Literature 1: JP 2003-129513A

BRIEF SUMMARY OF THE INVENTION

Problems to be Solved by the Invention

The widely used conventional connection structure of an excavator to a working vehicle includes a free end and a fixed end. A link shaft is provided on the free end, and a connection pin is provided on the fixed end. Usually, holes for insertion of a connection pin are located by making a guide plate contact a cylindrical boss member corresponding to the guide plate.

However, the shape of the introduction part of the guide plate is simply semicircular corresponding to the outline of the boss member. The contact portion of the guide plate with the boss member is linear so as to be subjected to large eccentric stress, thereby being damaged early, and thereby being unstable in recreating the accurate location of the holes for a long time. Further, the shape of the introduction part of the guide plate must correspond to the outline circle of the boss member thus requiring expensive accurate processing of the guide plate.

An object of the present invention is to provide a guide plate with an introduction part having a simple and effective shape such as to increase its rigidity against eccentric stress and to reduce the number of manufacturing processes. Another object of the invention is to simplify connecting the excavator to the working vehicle by partly modifying the structure of a connection pin.

Means for Solving the Problems

The above-mentioned problems are solved by the following means.

According to the invention, a fixing structure of a work machine in a connection mechanism of the work machine to a working vehicle, includes a connection pin to be inserted for fixing the work machine to the working vehicle. In the structure, the connection pin is fixedly provided with a U-shape bent member on an outer peripheral side surface of one end portion thereof and in the axial direction thereof.

When the other end of the connection pin is inserted into an insertion-target member of either the working vehicle or the work machine, tips of the U-shape bent member come into contact with the insertion-target member so as to axially locate the connection pin.

Of the working vehicle and the work machine, one includes a cylindrical boss member, and the other includes a guide plate having a chevron-shaped introduction part corresponding the cylindrical boss member.

A side-viewed shape of a surface of the introduction part of the guide plate to contact the cylindrical boss member has a curvature which is smaller than a curvature of an outer peripheral surface of the boss member so that the boss member contacts the surface of the introduction part of the guide plate at two positions on the outer peripheral surface.

The side-viewed shape of the surface of the introduction part to contact the boss member includes two arcs each having a radius that is longer than a radius of the boss member, and wherein the guide plate is placed so that centers of the arcs are located rearward from a center of the boss member and that the hole for insertion of the connection pin is located at an inside between the arcs.

The chevron-shaped introduction part has a lower guide portion and an upper guide portion which is shorter than the lower guide portion.

Effect of the Invention

The present invention constructed as the above brings the following effects.

According to the invention, the U-shape bent member provided on one end portion of the connection pin becomes a knob after the insertion of the connection pin. During the insertion of the connection pin, the U-shape bent member effects the later-discussed defining of the position of the connection pin. Since the U-shape bent member is disposed in the axial direction of the connection pin, a space for hammering the member during insertion of the connection pin is provided. If the connection pin is not in use, the member can serve as a hook for carrying the connection pin to another place.

When the other end of the connection pin is inserted into an insertion-target member of either the working vehicle or the work machine, tips of the U-shape bent member come into contact with the insertion-target member so as to axially locate the connection pin; thus, the insertion operation of the connection pin is easy and takes a short time.

Due to the chevron-shaped introduction part of the guide plate, the present structure is simple and is advantageous for economically and accurately locating the connection pin.

Since the side-viewed shape of the surface of the introduction part of the guide plate to contact the cylindrical boss member has a curvature which is smaller than a curvature of an outer peripheral surface of the boss member so that the boss member contacts the surface of the introduction part of the guide plate at two positions on the outer peripheral surface, an eccentric stress loaded on the boss member is reduced, thereby economically ensuring the required rigidity.

Since the side-viewed shape of the surface of the introduction part to contact the boss member includes two arcs each having a radius that is longer than a radius of the boss member, and the guide plate is placed so that centers of the arcs are located rearward from a center of the boss member and that the hole for insertion of the connection pin is located at an inside between the arcs, the simple-shaped guide plate can easily introduce a fixture portion of the work machine.

Since the chevron-shaped introduction part of the guide plate is designed so that the upper guide portion is shorter than the lower guide portion considering a locus of the cylindrical boss member centered on the link shaft, the connection operation is easy and takes a short time.

DETAILED DESCRIPTION OF THE INVENTION

The invention is intended to provide a connection mechanism to a connection portion between a working vehicle and an excavator. The connection mechanism has end members to be fixed to each other, and includes a chevron-shaped guide plate, and a connection pin provided with a U-shape bent member on a side surface of a rear portion thereof.

Embodiment 1

Entire Structure

A working vehicle serving as an embodiment of the invention will be described.

Figure 1:
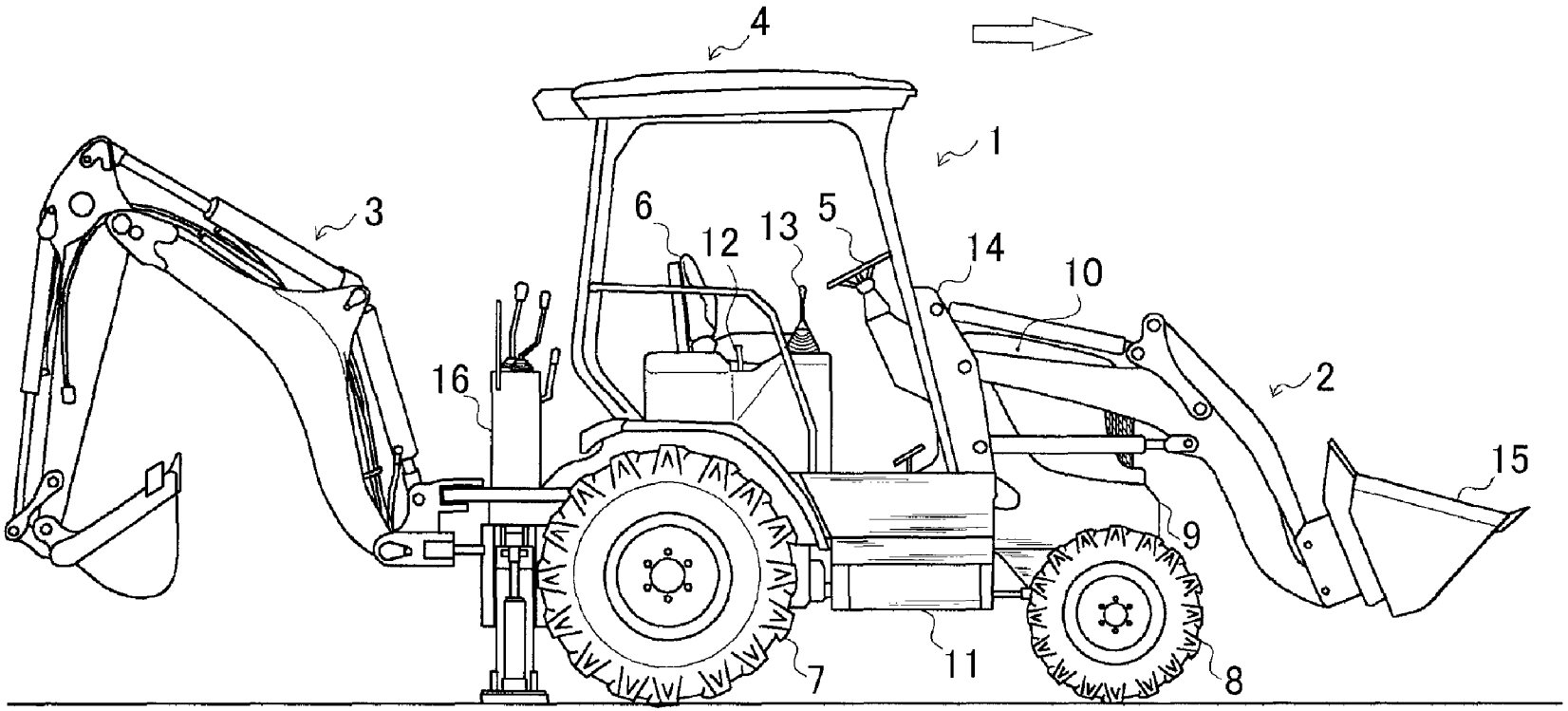
FIG. 1 is a side view of an entire working vehicle.

FIG. 1 is a side view of an entire working vehicle.

Working vehicle 1 shown in FIG. 1 is a tractor loader backhoe equipped at a front portion thereof with a loader 2, and at a rear portion thereof with an excavator 3. A middle portion of working vehicle 1 serves as an operation cab 4.

In working vehicle 1, a pair of front wheels 8 and a pair of rear wheels 7 are provided on side portions of a frame 9 so as to enable traveling of working vehicle 1 equipped with excavator 3 and loader 2.

In operation cab 4, an operator's seat 6 and a steering wheel 5 are disposed, and a traveling operation device 12 and a loader operation device 13 for operating loader 2 are disposed on sides of operator's seat 6. Therefore, an operator in operation cab 4 can operate traveling of working vehicle 1, and can operate loader 2. Loader 2 is connected to a mast 14 extended upward from side surfaces of a front portion of frame 9, and a bucket 15 is attached on a tip of loader 2. Loader 2 mainly serves as a device for loading materials.

Excavator 3 has a detachable attachment structure to be attached to a lateral opened rear portion of frame 9 through a connection pin. Excavator 3 is operated by an operation device 16 disposed behind operator's seat 6. Excavator 3 is mainly used for excavation of soil, sand or the like.

An engine serving as a prime mover and its relevant implements are mounted on a front portion of frame 9 serving as a chassis of working vehicle 1, and are covered with a hollow bonnet 10 formed at an upper portion thereof from resinous material. Loader 2 is disposed outside of bonnet 10.

An operation fluid tank 11 of operation fluid for driving loader 2 and excavator 3 is disposed at one of left and right lower portions of operation cab 4, and a fuel tank is disposed at the other of left and right lower portions of operation cab 4 opposite to operation fluid tank 11. Operation fluid tank 11 also serves as a step for an operator riding on-and-off operation cab 4.

Connection Structure on Frame

Detailed description will now be given of a structure of the rear portion of working vehicle 1 to be connected to excavator 3.

Figure 2:
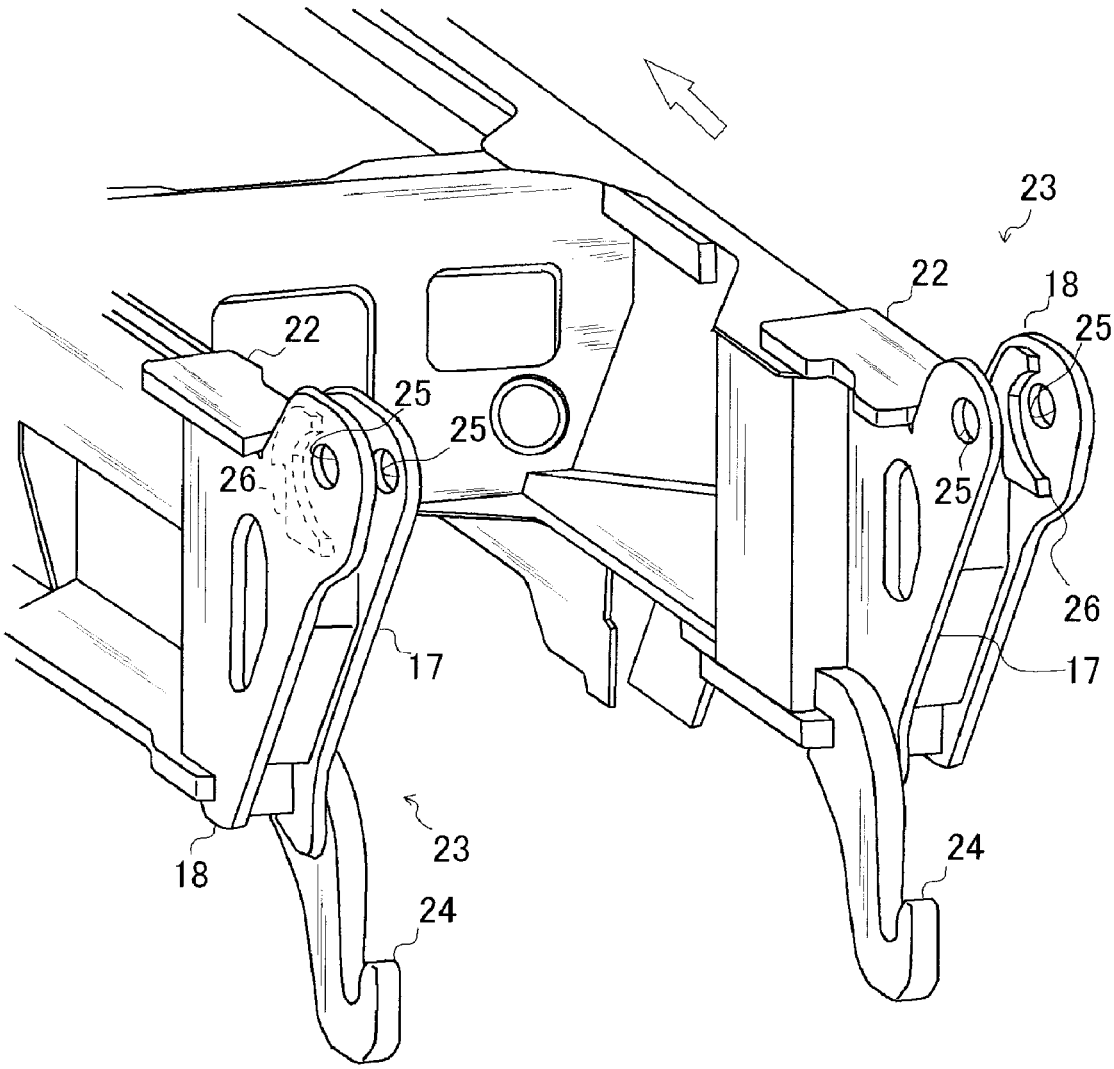
FIG. 2 is an upper and rear perspective view of a frame of the working vehicle.
Figure 3:
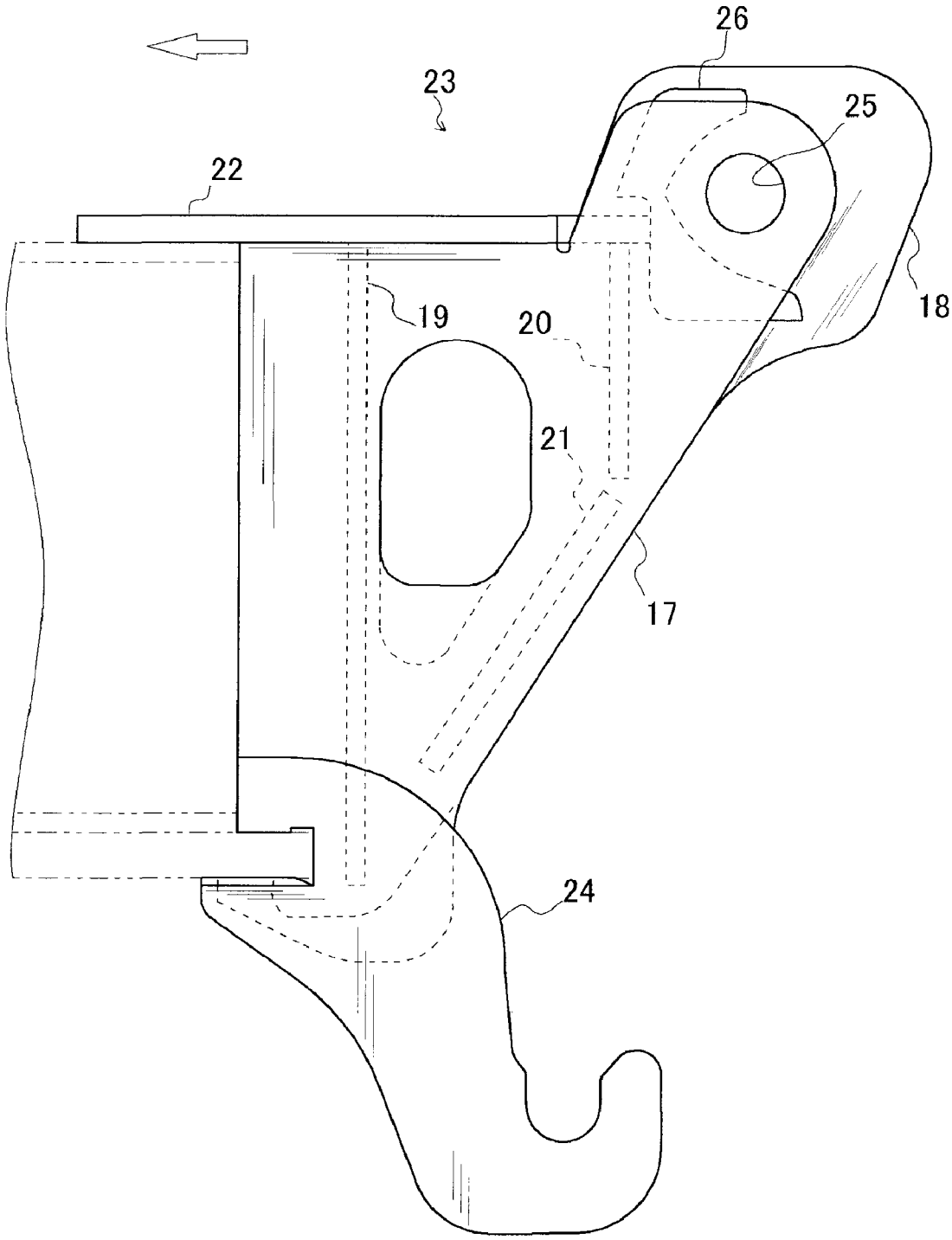
FIG. 3 is a detailed view of an inner side of connection portion of the frame.
Figure 4:
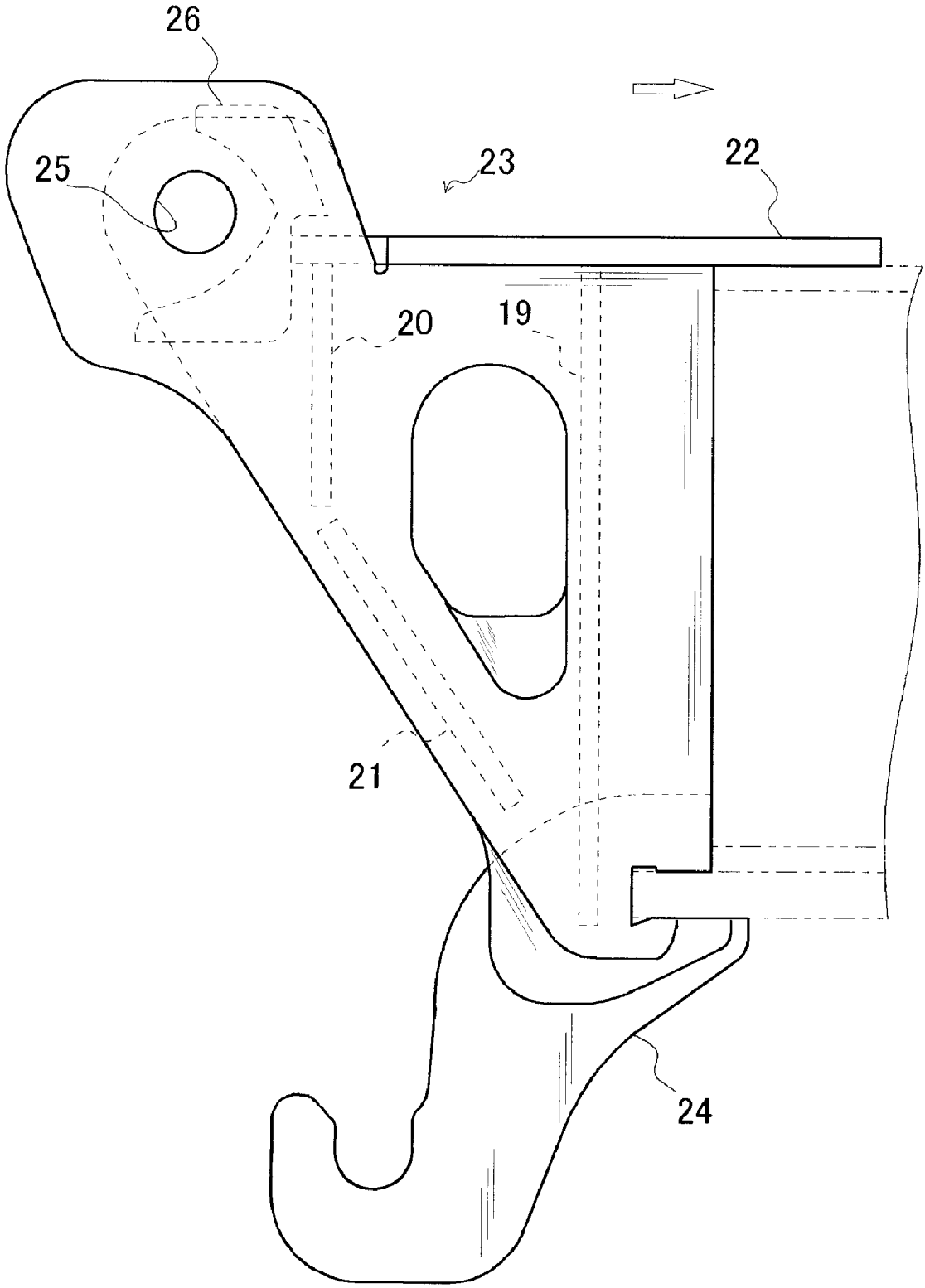
FIG. 4 is a detailed view of an outer side of connection portion of the frame.
Figure 5:
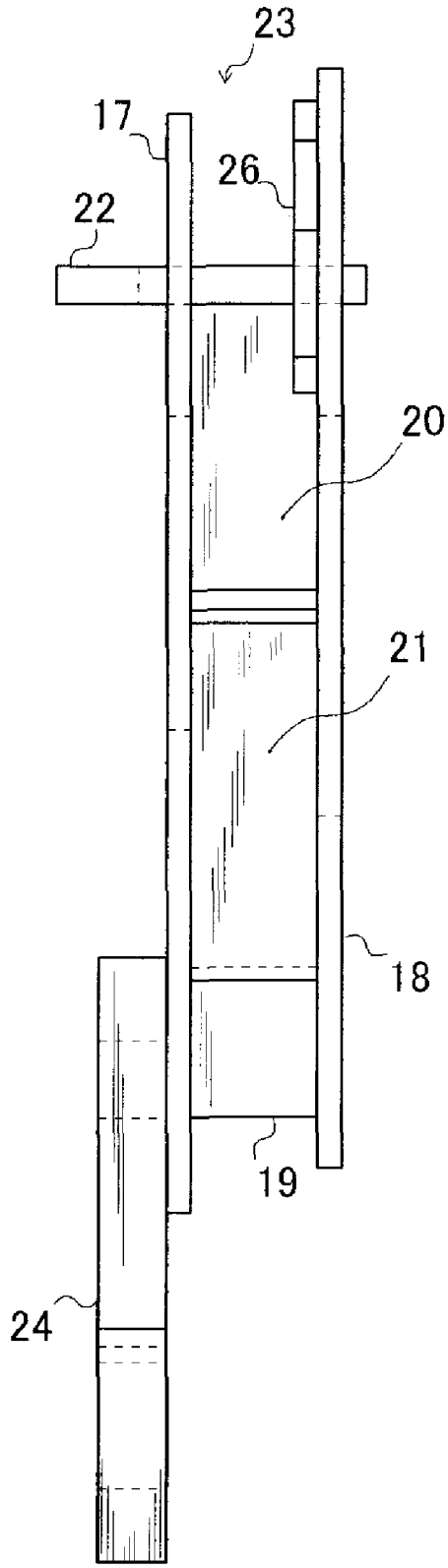
FIG. 5 is a detailed view of a rear side of connection portion of the frame.
Figure 6:
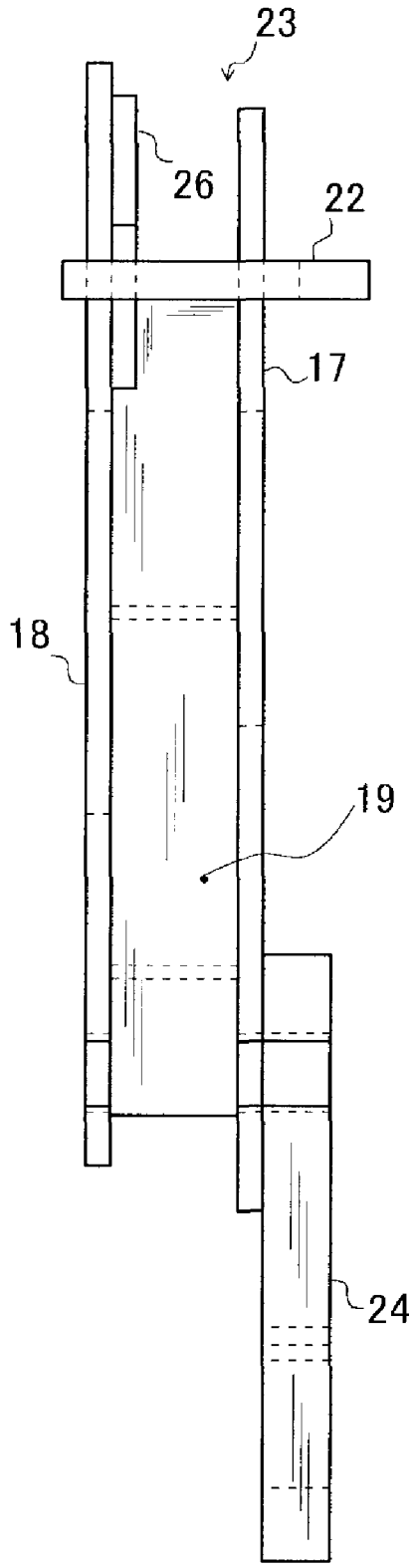
FIG. 6 is a detailed view of a front side of connection portion of the frame.
Figure 7:
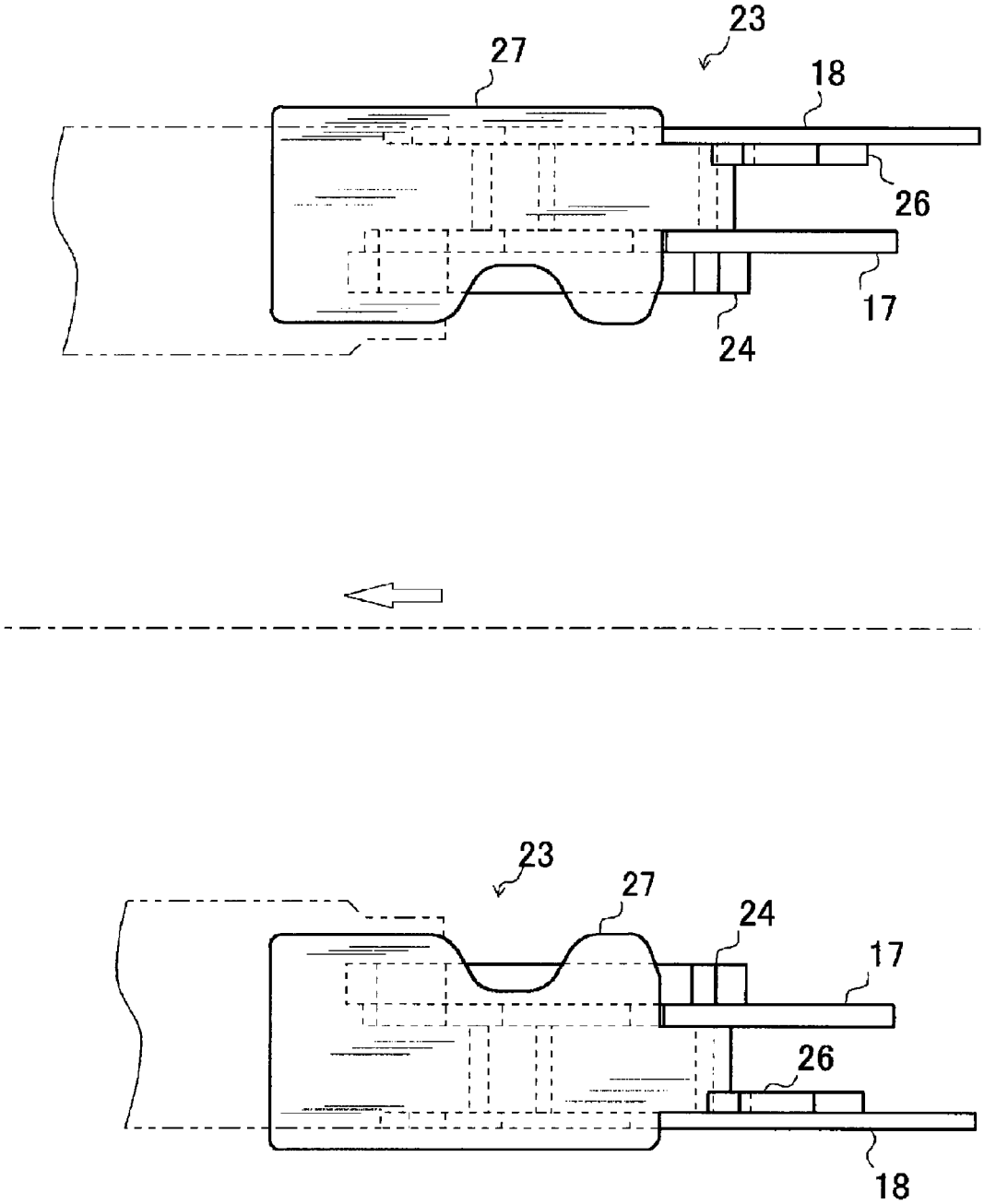
FIG. 7 illustrates detailed views of an upper side of connection portion of the frame.

FIG. 2 is an upper and rear perspective view of a frame of the working vehicle;

FIG. 3 is a detailed view of an inner side of connection portion of the frame;

FIG. 4 is a detailed view of an outer side of connection portion of the frame;

FIG. 5 is a detailed view of a rear side of connection portion of the frame;

FIG. 6 is a detailed view of a front side of connection portion of the frame; and FIG. 7 illustrates detailed views of an upper side of connection portion of the frame.

Left and right symmetric connection portions 23 to be connected to excavator 3 are joined to the rear portion of frame 9 of working vehicle 1 by welding.

Each connection portion 23 includes two side surface plates 17 and 18, reinforcing plates 19, 20 and 21 disposed between side surface plates 17 and 18, and an upper plate 22, thereby being formed into a box shape having a sufficient rigidity.

More specifically, two right-triangle iron plates reversed to have apexes at their bottoms serve as inner side surface plate 17 and outer side surface plate 18 which are opposite to each other. Sectionally rectangular iron plates 19, 20 and 21 are disposed between inner and outer side surface plates 17 and 18 along the outlines of side surface plates 17 and 18. Plates 17 and 18 are joined to each other through the single iron plate closing the upper space of these plates.

A hook plate 24 is formed at a rear lower end portion thereof into an upwardly opened hook shape, and is joined to a lower portion of inner side surface plate 17, so as to partly overlap inner side surface plate 17.

This hook shape is provided for temporarily supporting excavator 3 on frame 9 during attachment of excavator 3.

Holes 25 for insertion of a connection pin are provided in opposite upper rear expanding portions of side surface plates 17 and 18 so as to let the connection pin penetrate side surface plates 17 and 18.

Outer side surface plate 18 is provided on an inside surface thereof with a guide plate 26 adjacent to hole 25. Guide plate 26 serves as a stopper for the excavator while being attached, and also serves as a reinforcement member against eccentric stress.

Guide plate 26 may be provided on only one of left and right connection portions 23. Either left or right connection portion 23 can be provided with guide plate 26.

Connection Structure on Excavator

Detailed description will now be given of a structure of excavator 3 to be connected to working vehicle 1.

Figure 8:
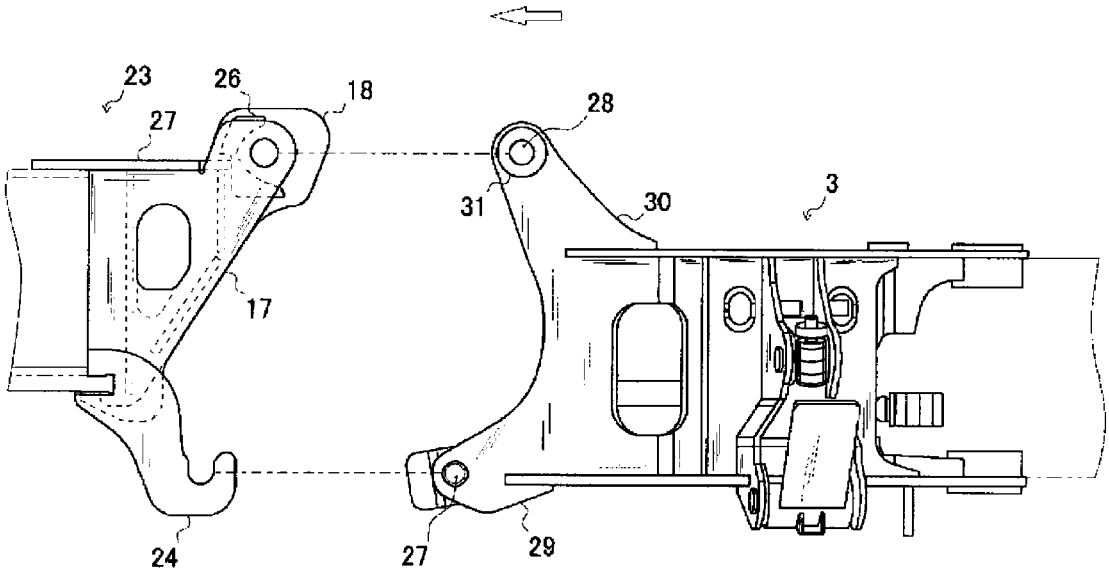
FIG. 8 is a side view of an excavator and a connection portion.

FIG. 8 is a side view of excavator 3 and connection portions 23.

In the connection portion of excavator 3, left and right opposite link shafts 27 are provided on respective left and right lower forward expanded portions thereof so as to be disposed laterally coaxially to each other when viewed in front, and left and right opposite holes 28 for insertion of the connection pin are provided in respective left and right upper forward expanded portions so as to be disposed laterally coaxially to each other when viewed in front.

Each link shaft 27 is disposed perpendicularly between opposite side surface plates 29 and 30 which are extended outward in parallel. During the connection, hook plate 24 of each connection portion 23 comes to be sandwiched at opposite side surfaces thereof between side surface plates 29 and 30 of excavator 3, so as to be located laterally with respect to the traveling direction of the vehicle.

To make hole 28 for insertion of the connection pin 32, a cylindrical boss member 31 is passed through outer side surface plate 30 and joined to outer side surface plate 30 by welding, an axial hole is formed through boss member 31, and is finished by machining so as to have an appropriate dimension. Therefore, in comparison with the hole formed in side surface plate 30 itself, hole 28 has the length of boss member 31 so as to increase its area contacting connection pin 32, thereby increasing resistance against shearing stress.

Connection Process

Description will now be given of a process of connecting excavator 3 to connection portions 23.

Figure 9:
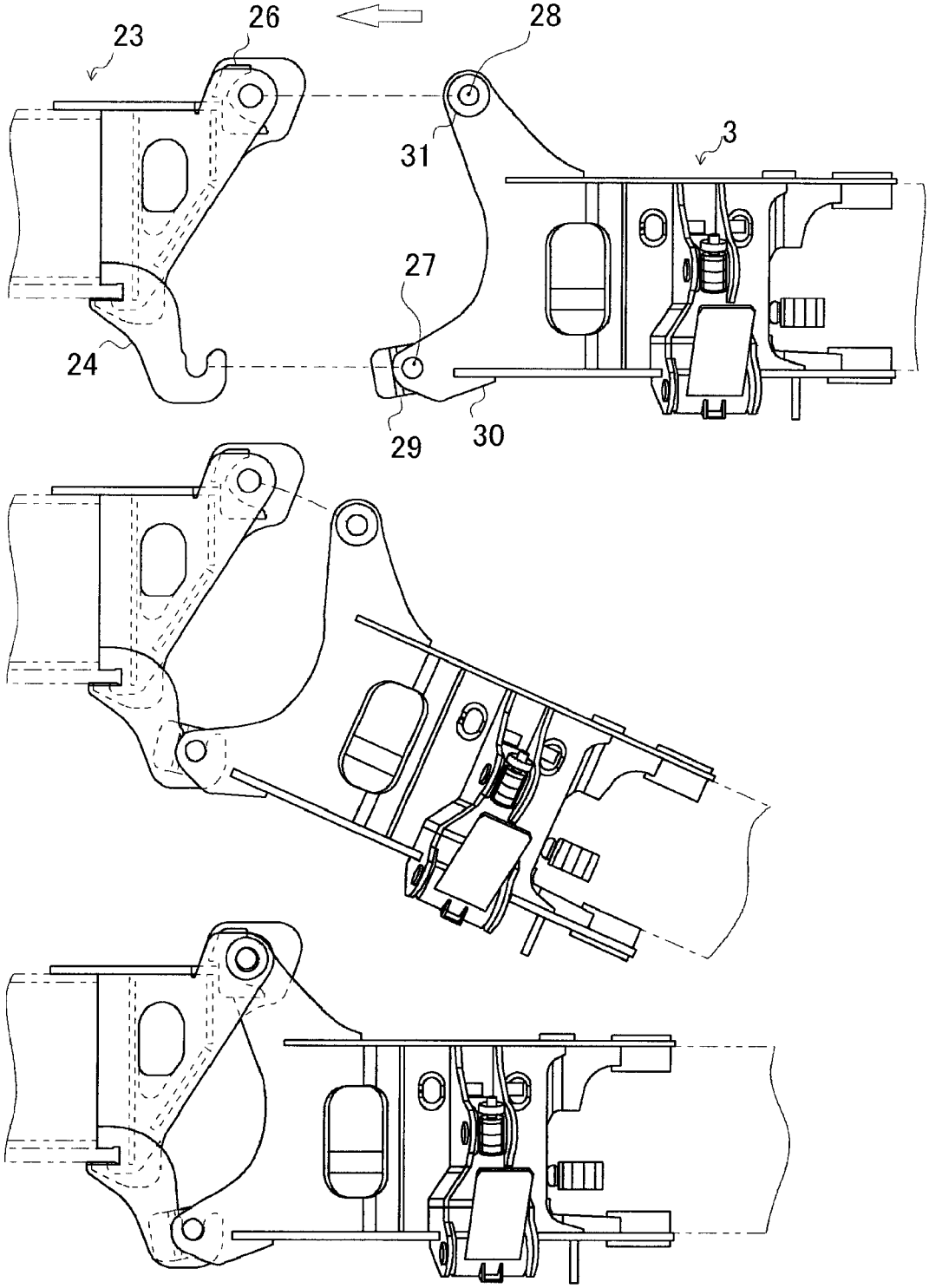
FIG. 9 illustrates side views of the excavator and the connection portion step by step during connection thereof.

FIG. 9 illustrates side views of the excavator and the connection portion step by step during connection thereof.

In the process of connecting excavator 3 to connection portions 23, firstly, link shafts 27 of excavator 3 are fitted to hook plates 24 of connection portions 23, so the lower front portions of excavator 3 are supported by hook plates 24. Then, excavator 3 is rotated centered on link shafts 27 so that boss members 31 of excavator 3 come into contact with guide plates 26 of connection portions 23, thereby locating and holding the holes for insertion of connection pin 32. Finally, connection pin 32 is fittingly inserted so as to fix excavator 3 to connection portions 23.

Detail of Connection Portion

Detailed description will now be given of attachment of connection pin 32 between excavator 3 and connection portions 23.

Figure 10:
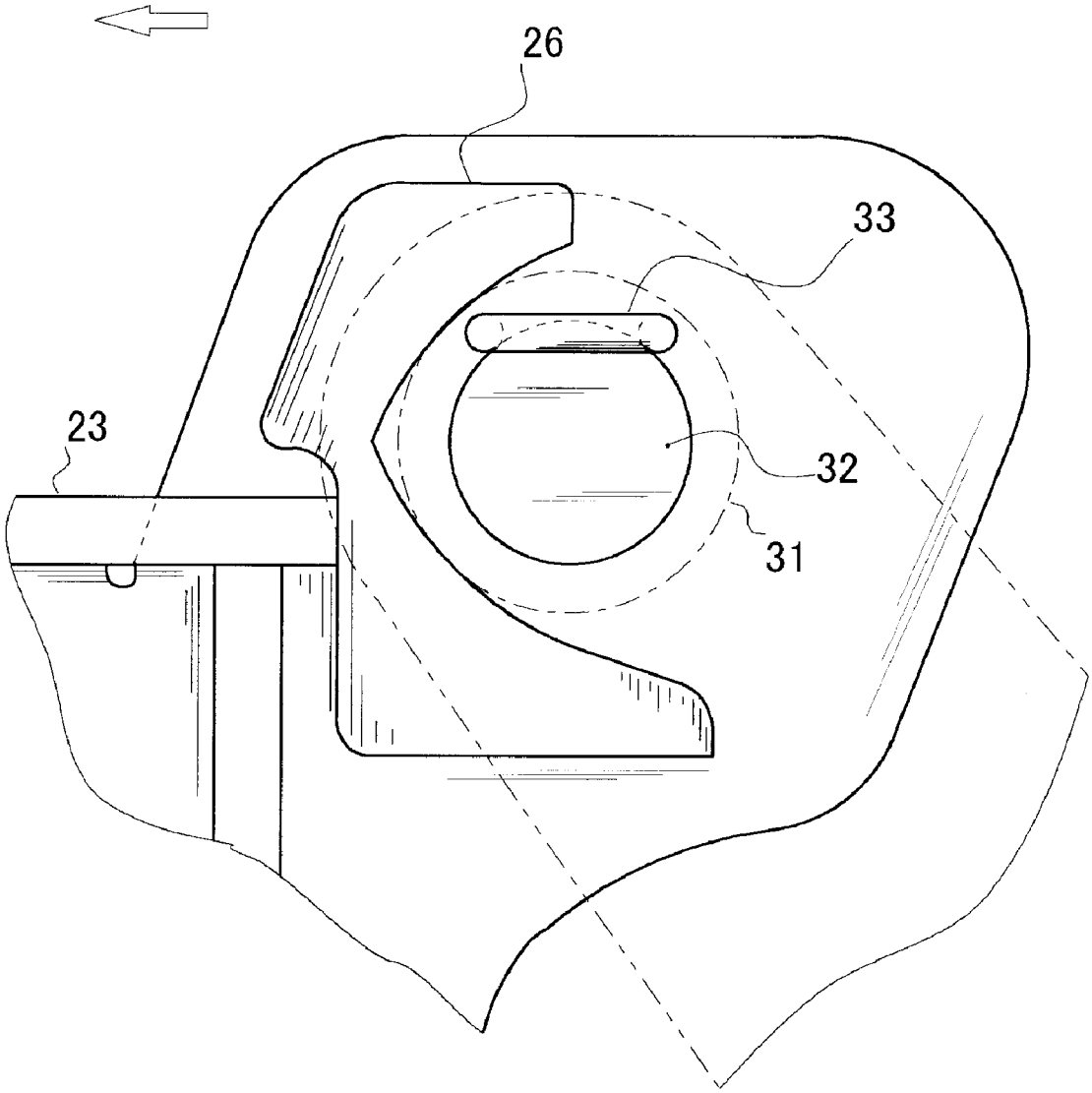
FIG. 10 is a detailed view of the excavator connected to the connection portion through a connection pin.

FIG. 10 is a detailed view of a guide plate of the excavator connected to the connection portion through a connection pin.

Each guide plate 26 is formed with a chevron-shaped introduction part having a curvature which is smaller than a curvature of an outer peripheral surface of boss member 31. The side-viewed shape of the surface of guide plate 26 to contact boss member 31 includes two arcs each having a radius that is longer than a radius of boss member 31. Guide plate 26 is placed so that centers of the arcs are located rearward from a center of hole 28 for insertion of the connection pin, and so that hole 28 for insertion of the connection pin is located at an inside between the arcs.

As mentioned above, boss members 31 of excavator 3 are made to contact guide plates 26 of connection portions 23 so as to define the position of excavator 3 attached to connection portions 23. Guide plate 26 is chevron-shaped, that is, it has a recess whose width increases toward its open side. Boss members 31 are rotated centered on link shafts 27 so as to be guided into position. Therefore, the chevron-shaped introduction part has a lower guide portion and an upper guide portion, so that the lower guide portion is longer than the upper guide portion, thereby being prevented from interfering with boss member 31. The opening direction of guide plate 26 substantially coincides to a tangent line extended from an arc passing guide plate 26 centered on link shaft 27. Therefore, boss member 31 is easily introduced into the introduction part. Further, in comparison with a semicircular guide, the present guide can constantly contact boss member 31 at two portions thereof so as to define the position of boss member 31, thereby increasing its resistance against eccentric stress.

The chevron-shape of guide plate 26 is the combination of the two arcs having different centers when viewed in side so as to reduce the distance between the arcs as it goes forward. Boss member 31 contacts the portions of guide plate 26 represented as the arcs. The two sector curves have radii that are larger than the radius of boss member 31 so as to surely bring guide plate 26 into areal contact with boss member 31, thereby reducing eccentric stress and increasing the resistance against the eccentric stress in comparison with the semicircular guide which may linearly contact the boss member due to the accuracy of manufacturing.

Detail of Connection Pin

Detail description will now be given of connection pin 32.

Figure 11:
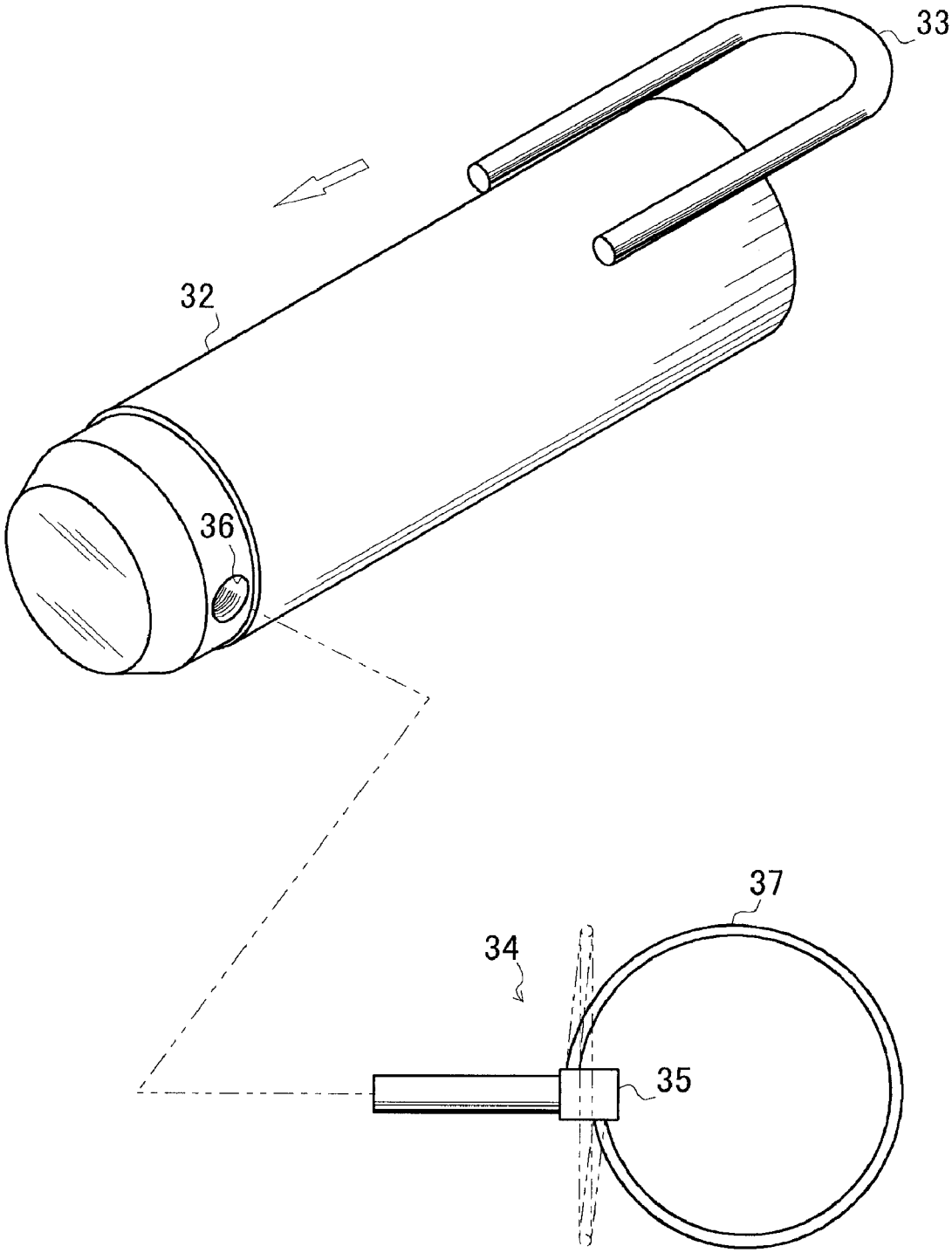
FIG. 11 is a perspective view of the connection pin.
Figure 12:
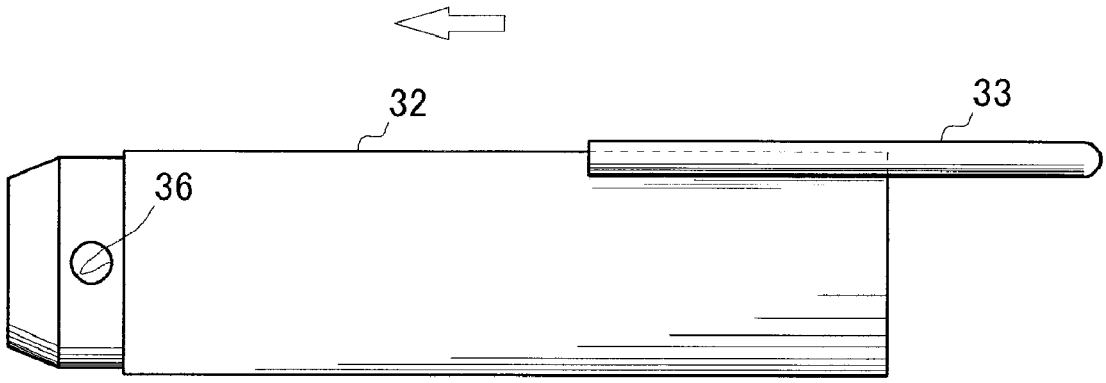
FIG. 12 is a right side view of the connection pin.
Figure 13:
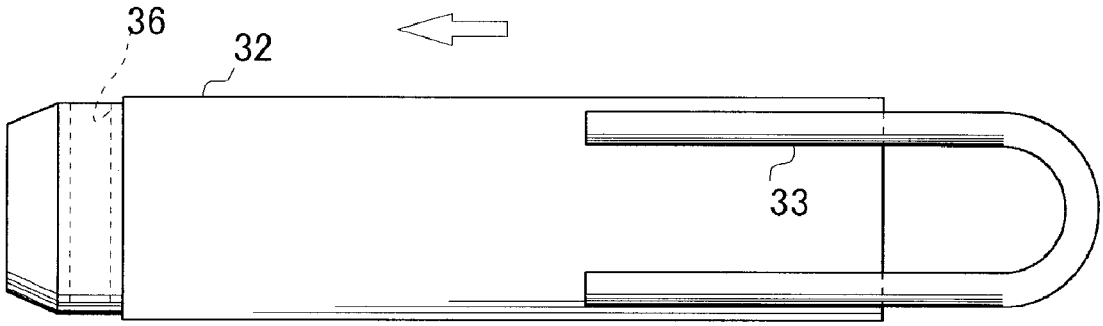
FIG. 13 is a plan view of the connection pin.
Figure 14:
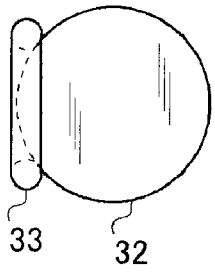
FIG. 14 is a back view of the connection pin.

FIG. 11 is a perspective view of the connection pin;

FIG. 12 is a right side view of the connection pin;

FIG. 13 is a plan view of the connection pin;

FIG. 14 is a back view of the connection pin; and

Figure 15:
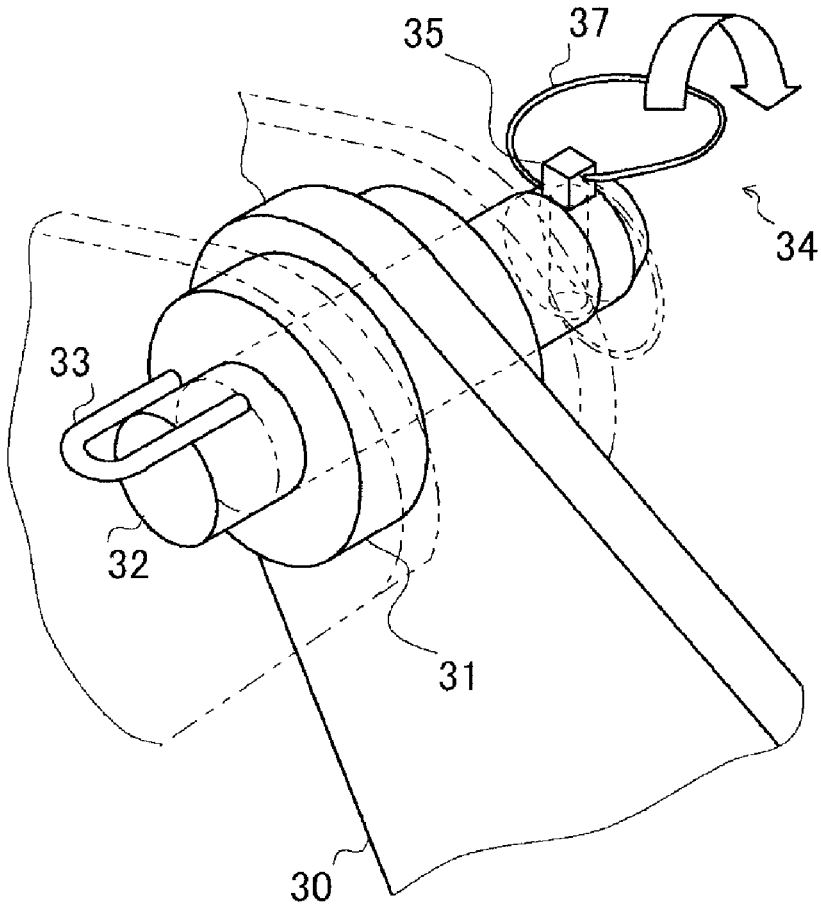
FIG. 15 is an upper and rear perspective view of the excavator connected to the connection portion through a connection pin.

FIG. 15 is an upper and rear perspective view of the excavator connected to the connection portion through a connection pin.

Connection pin 32 is circularly columnar, and has a tapered front tip such as to be easily inserted into holes 28 of boss members 31 and holes 25 of connection portions 23. A knob 33 is made of a U-shape bent member, and is disposed on an outer peripheral side surface of a rear portion of connection pin 32 in the axial direction of connection pin 32. In this way, knob 33 is offset from the axis of connection pin 32 and is disposed on the side surface of connection pin 32. Therefore, knob 33 surely has a rear surface whose center portion is adapted to be knocked by a hammer or the like when connection pin 32 is inserted. When connection pin 32 is not in use, knob 33 can be hooked for carrying connection pin 32 to another place. The member serving as knob 33 can be small in its longitudinal direction. The proper position of inserted connection pin 32 is defined as the position where tips of knob 33 come into contact with connection portion 23. Thus, the determined attachment position of connection pin 32 can be economically recreated.

A diametrically penetrating hole 36 is provided in the front portion of connection pin 32 offset from the tapered tip of connection pin 32. A retaining pin 34 is inserted into hole 36. Retaining pin 34 is circularly columnar, and has a tapered tip to be easily inserted into hole 36. The end portion of retaining pin 34 opposite to the tapered tip has a section which is outwardly expanded from the columnar section so as to serve as a pin head 35 for preventing inserted retaining pin 34 from escaping. A ring 37, whose inner diameter is larger than the outer diameter of connection pin 32, is provided on pin head 35 so as to be used as a knob for attachment and detachment of retaining pin 34. Ring 37 is rotatable centered on its portions joined to the pin head, so that, after retaining pin 34 is completely inserted, connection pin 32 can be retained in the inner diameter range of rotated ring 37 so as to be prevented from interfering with other parts.

Industrial Applicability

The present invention relates to a fixing structure of a work machine to a working vehicle, and is applicable as a connection structure of an excavator.

The invention claimed is:

1. A structure for connecting a work machine to a working vehicle, comprising:

an insertion-target member of one of the working vehicle and the work machine, the insertion-target member having a hole;

a guide member of the other of the working vehicle and the work machine, the guide member having a hole to be placed to coincide to the hole of the insertion-target member, and having a surface surrounding the hole of the guide member;

a connection pin having first and second axial ends opposite to each other in the axial direction thereof, wherein the first axial end of the connection pin is adapted to be inserted into the hole of the insertion-target member through the hole of the guide member for connecting the work machine to the working vehicle; and a U-shape bent member having a pair of tips, a middle portion defined as a curved portion of the U-shape thereof, and a pair of parallel linear portions extending between the middle portion and the respective tips, wherein the parallel linear portions are fixed on an outer peripheral side surface of the connection pin so as to extend in the axial direction of the connection pin, so that the tips are disposed on the outer peripheral surface of the connection pin between the first and second axial ends of the connection pin, and so that the middle portion is disposed outward from the second axial end of the connection pin, whereby, when the first axial end of the connection pin is inserted into the insertion-target member, the tips of the U-shape bent member come into contact with the surface of the guide member so as to axially locate the connection pin.

2. The structure according to claim 1, wherein a cylindrical boss member serves as the insertion-target member, and wherein a guide plate, having a chevron-shaped introduction part corresponding to the cylindrical boss member, serves as the guide member.

3. The structure according to claim 2, wherein a shape of a surface of the introduction part of the guide plate that contacts the cylindrical boss member, when viewed from the side, has a curvature which is smaller than a curvature of an outer peripheral surface of the boss member so that the boss member contacts the surface of the introduction part of the guide plate at two positions on the outer peripheral surface.

4. The structure according to claim 3, wherein the shape of the surface of the introduction part that contacts the boss member includes two arcs each having a radius that is longer than a radius of the boss member, and wherein the guide plate is placed so that centers of the arcs are located rearward from a center of the boss member and so that the hole for insertion of the connection pin is located at an inside between the arcs.

5. The structure according to claim 2, wherein the chevron-shaped introduction part has a lower guide portion and an upper guide portion which is shorter than the lower guide portion.

6. The structure according to claim 1, wherein the middle portion of the U-shape bent member is spaced apart from the second axial end of the connection pin so as to serve as a knob.

7. The structure according to claim 1, wherein the connection pin has a circular sectional shape perpendicular to the axial direction thereof, and wherein a distance between the parallel linear portions of the U-shape bent member is smaller than a diameter of the circular sectional shape of the connection pin.

* * * * *